US006508719B1

(12) United States Patent
Reddick

(10) Patent No.: US 6,508,719 B1
(45) Date of Patent: Jan. 21, 2003

(54) GOLF CUP RETAINING HOLDER FOR ARTIFICIAL GREENS

(76) Inventor: Randolph S. Reddick, P.O. Box 1001, Calhoun, GA (US) 30703

( * ) Notice: Subject to any disclaimer, the term of this patent is extended or adjusted under 35 U.S.C. 154(b) by 0 days.

(21) Appl. No.: 09/902,142

(22) Filed: Jul. 10, 2001

(51) Int. Cl.[7] ..... A63B 69/36
(52) U.S. Cl. ..... 473/175
(58) Field of Search ..... 473/171, 173, 473/175–179, 174, 196, 180

(56) References Cited

U.S. PATENT DOCUMENTS

| | | | | | |
|---|---|---|---|---|---|
| 3,511,501 | A | * | 5/1970 | Sandberg | 47/41.1 |
| 3,643,944 | A | | 2/1972 | Boyes | 273/34 R |
| 3,772,841 | A | * | 11/1973 | Barak et al. | 473/176 |
| 4,007,307 | A | | 2/1977 | Friedrich | 428/17 |
| 4,204,682 | A | * | 5/1980 | Brown | 273/401 |
| 4,280,698 | A | * | 7/1981 | Troiano | 473/179 |
| 5,029,856 | A | | 7/1991 | Bookspan | 273/34 R |
| 5,120,063 | A | * | 6/1992 | Birchler et al. | 473/180 |
| 5,228,685 | A | * | 7/1993 | Williamson | 172/19 |
| 5,382,018 | A | * | 1/1995 | Browne | 172/1 |
| 5,390,917 | A | * | 2/1995 | Mendoza | 473/179 |
| 5,427,371 | A | * | 6/1995 | Huston et al. | 473/180 |
| 5,524,891 | A | * | 6/1996 | Owen et al. | 473/179 |
| 5,788,581 | A | * | 8/1998 | Mabie | 40/642.01 |
| 6,110,053 | A | * | 8/2000 | Sjoblom | 473/179 |
| 6,267,688 | B1 | * | 7/2001 | Morelli, Sr. | 473/175 |

* cited by examiner

*Primary Examiner*—Mark S. Graham
(74) *Attorney, Agent, or Firm*—McNair Law Firm, P.A.; Henry S. Jaudon

(57) ABSTRACT

A golf cup retaining system for use with artificial putting greens. The golf cup retaining system includes a retaining tube positioned in the ground at a selected area of the artificial green. An anchor plate secures with the upper portion of the retaining tube to secure it against lateral movement. Flaps of artificial carpet extend into the upper opening of the retaining tube and the golf cup is positioned against the carpet and into the retaining tube. The carpet acts to secure the cup in position while the cup acts to retain the carpet about the opening into the retaining tube in a taut and smooth condition.

21 Claims, 3 Drawing Sheets

11
14
34
32
38
24
28
26
24
22
19'
19'
20
20
19
18
19

GOLF CUP RETAINING HOLDER FOR ARTIFICIAL GREENS

BACKGROUND OF THE INVENTION

The instant invention is directed to a golf cup retaining system for use with artificial putting surfaces.

Artificial putting surfaces have long been in use for miniature golf and practice putting areas. With the increased interest in golf the demand for more realistic artificial putting greens grew. This demand requires that the feel between artificial and natural putting surfaces become approximately the same. This required providing under surface with more resilience and elasticity than heretofore required. Also, more natural lips for the hole housing the golf cup is desired. Also, a means to locate the cup in a stable position is required.

Accordingly, it is an object of this invention to provide a golf cup retaining system which provides a natural appeasing lip for the cup hole.

Another object is to provide a permanently positioned golf cup receiving tube.

Another object is to provide a golf cup receiving tube which is firmly stabilized in a vertical position relative to the putting surface.

Another object of the invention is to provide a base layer which is sufficiently resilient and soft to receive golf shots softly and return to its original position.

Another object of the invention is the provision of a plastic sheet formed with elevated hollow cups for forming a resilient base layer with good recovery qualities.

Another object of the invention is to provide an apparatus which grips the synthetic turf in the area of the golf hole and holds it in a smooth, taut condition.

Another object is an artificial green easily installed and maintained.

SUMMARY OF THE INVENTION

The above objectives are accomplished according to the present invention by a golf cup retaining system for artificial greens which includes a prepared surface, a base and a sheet of artificial turf. The retaining system comprises a plastic retaining tube with one end embedded in the prepared surface below the base with its upper end substantially aligned with the upper surface of the base. The artificial turf is positioned over the base and over the upper end of the retaining tube. Segments of the artificial turf extend into the opening at the upper end.

The golf cup when positioned in the retaining tube below the upper end is engaged by the segments of artificial turf and resiliently and releasably secured in the retaining tube. Simultaneously the artificial turf is stretched into a smooth, taut position about the upper surface of the plastic retaining tube and held in that condition by the golf cup.

The retaining tube includes a pair of opposed ears arranged along its periphery. The ears in parallel with the longitudinal axis of the retaining tube to a position just short of the upper edge. A slot is provided in each of the ears perpendicular to the longitudinal axis at a selected distance beneath the upper end. An anchor plate, having a central opening with a pair of opposed outwardly directed slits, is positioned about the retaining tube with the ears received through the slits.

A locking system is provided between the anchor plate and the retaining tube which comprises rotating the anchor plate so that upper and lower surfaces thereof are received within the slots.

The anchor plate is adapted to rest upon the prepared surface in locked condition with the retaining tube, stabilizing the retaining tube in a vertical position. The anchor plate is formed of a substantially square shaped metal plate.

The base is formed of synthetic plastic cups positioned over the prepared surface. The cups act to smooth out deviations in the prepared surface and to provide a resilient sub-surface for receiving the impact of arriving golf balls. The area about and between the cups is filled with sand forming a smooth upper surface for said base. The plastic cups are formed in a plastic sheet. The structure provides excellent recovery properties.

A golf cup retaining system for use with artificial greens comprising a retaining tube adapted to receive a golf cup. The retaining tube is constructed of two semicircular pieces and includes at least one elongated ear arranged along its periphery and parallel with its longitudinal axis. The ear terminates below and adjacent the upper end of the retaining tube. A retaining plate is arranged about the retaining tube in locked position. The retaining tube acts to stabilize the upper end of the retaining tube when positioned with the artificial green.

A method of providing a golf cup retaining system including the steps of providing a prepared surface over a selected area, providing a retaining tube and burying a lower portion of the retaining tube beneath the prepared surface, forming a base layer over the prepared surface of a depth which brings its upper surface substantially even with the upper end of the retaining tube, laying artificial turf over the base layer and over the upper end of the retaining tube, cutting the artificial turf extending over the upper end forming a plurality of strips which extend downwardly into the retaining tube drawing the turf taut, and positioning the golf cup within the retaining tube and in engagement with the strips of artificial turf causing the strips to resiliently lock with the cup holding both the carpet and cup in position.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
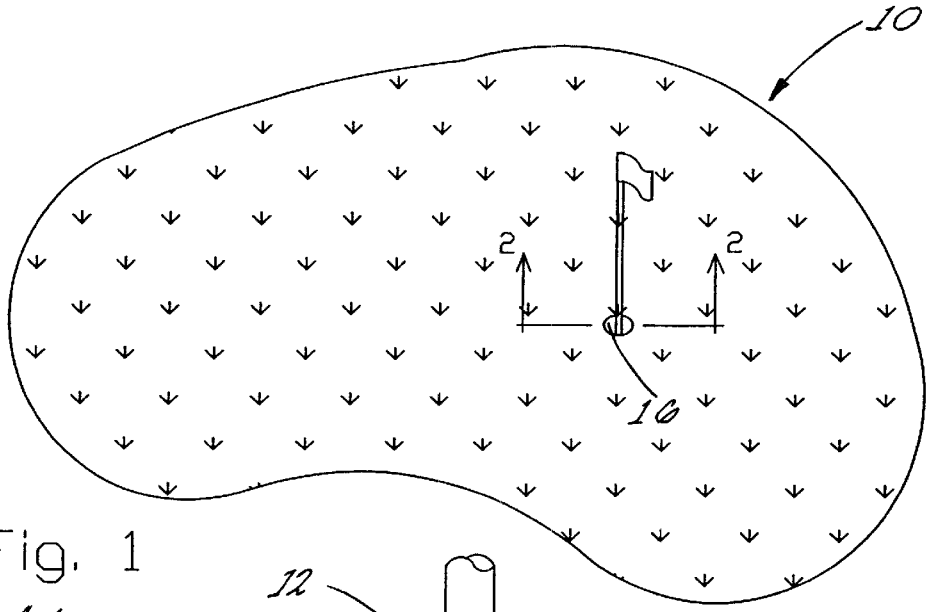
FIG. 1 is a diagrammatic perspective view of a golf green.

A configured artificial putting green 10 is shown in FIG. 1. The artificial green is constructed over a prepared ground surface and includes a sub-base, a base, and a putting surface. A hole is formed in a selected area and a golf cup is positioned in the hole.

Figure 2:
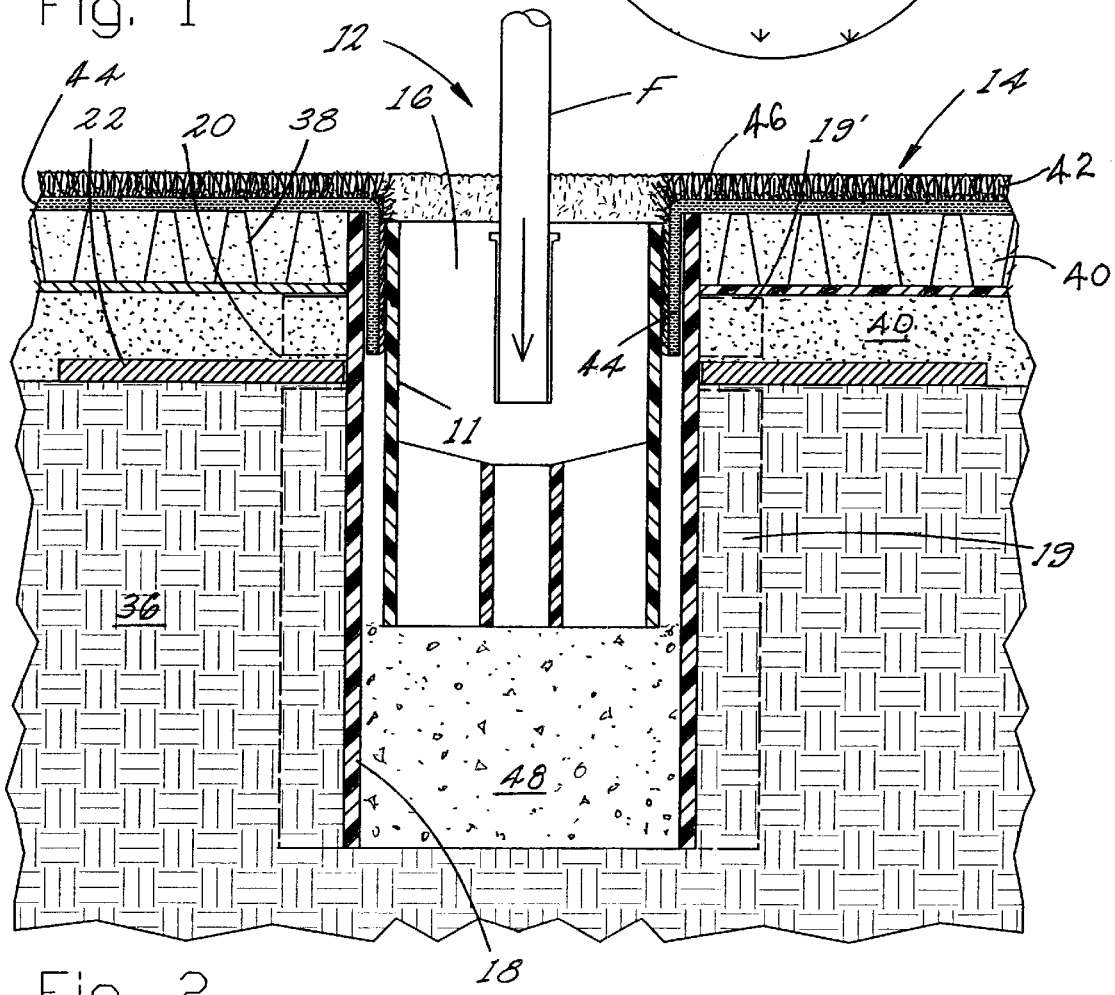
FIG. 2 is a side cross-sectional view of the green taken along line 2—2.

The invention is directed to a golf cup retaining system 12, as shown in FIG. 2, which also acts to maintain the artificial turf 14 about the golf hole 16 in a taut and smooth condition.

Figure 3:
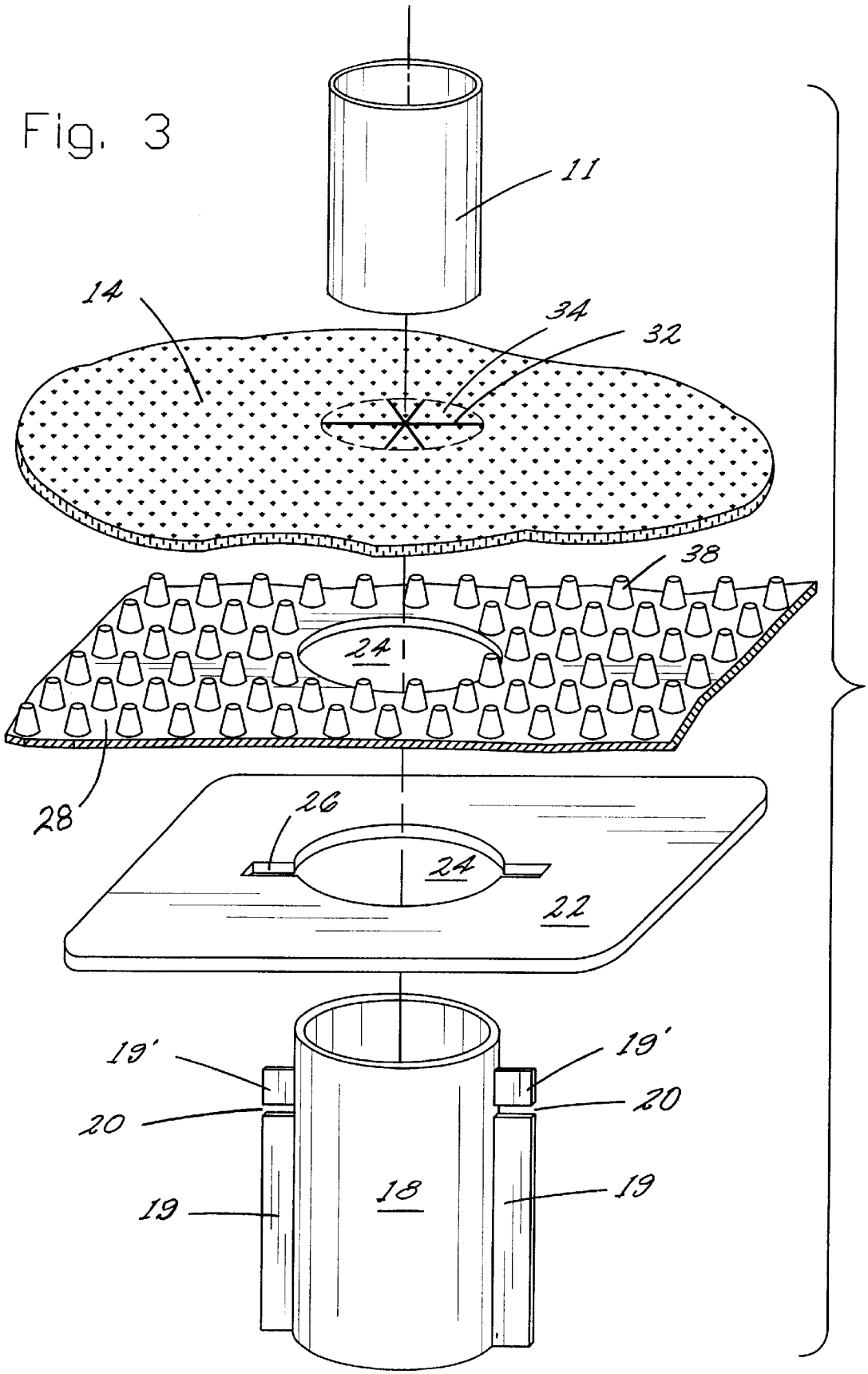
FIG. 3 is an exploded perspective view of the golf green and cup retaining members.

The golf cup retaining system, as seen in FIG. 3, consists of a retaining tube 18 which is about 5" in diameter and about 9½" long. These dimensions may vary just so long as the tube is large enough to receive the golf cup and a portion of the artificial turf. Also, the tube needs to be only so long as to firmly anchor the lower end thereof in the ground and provide sufficient space beneath the golf cup for drainage. Preferably the retaining tube is made of plastic and in one or two pieces. The two piece construction will be described later in the description.

Arranged on opposed sides of retaining tube 18 are a pair of vertically extending ears 19 which extend from the lower edge of the tube to a point about 1" short of the upper edge thereof. Ears 19, which are diametrically opposed, extend outward from the periphery of the tube about 1". A slot 20 is formed in each ear 19 about 1" below its upper edge forming upper ears 19'. Slot 20 is slightly larger than the width of anchor plate 22.

Anchor plate 22 is made preferably of heavy metal which is about 1/16" thick and 16" square. An opening 24 is cut in the center thereof. Opening 24 mirrors the shape of retaining tube 18, to include a pair of opposed slits 26, and is sized to receive the retaining tube 18 there through.

Figure 4:
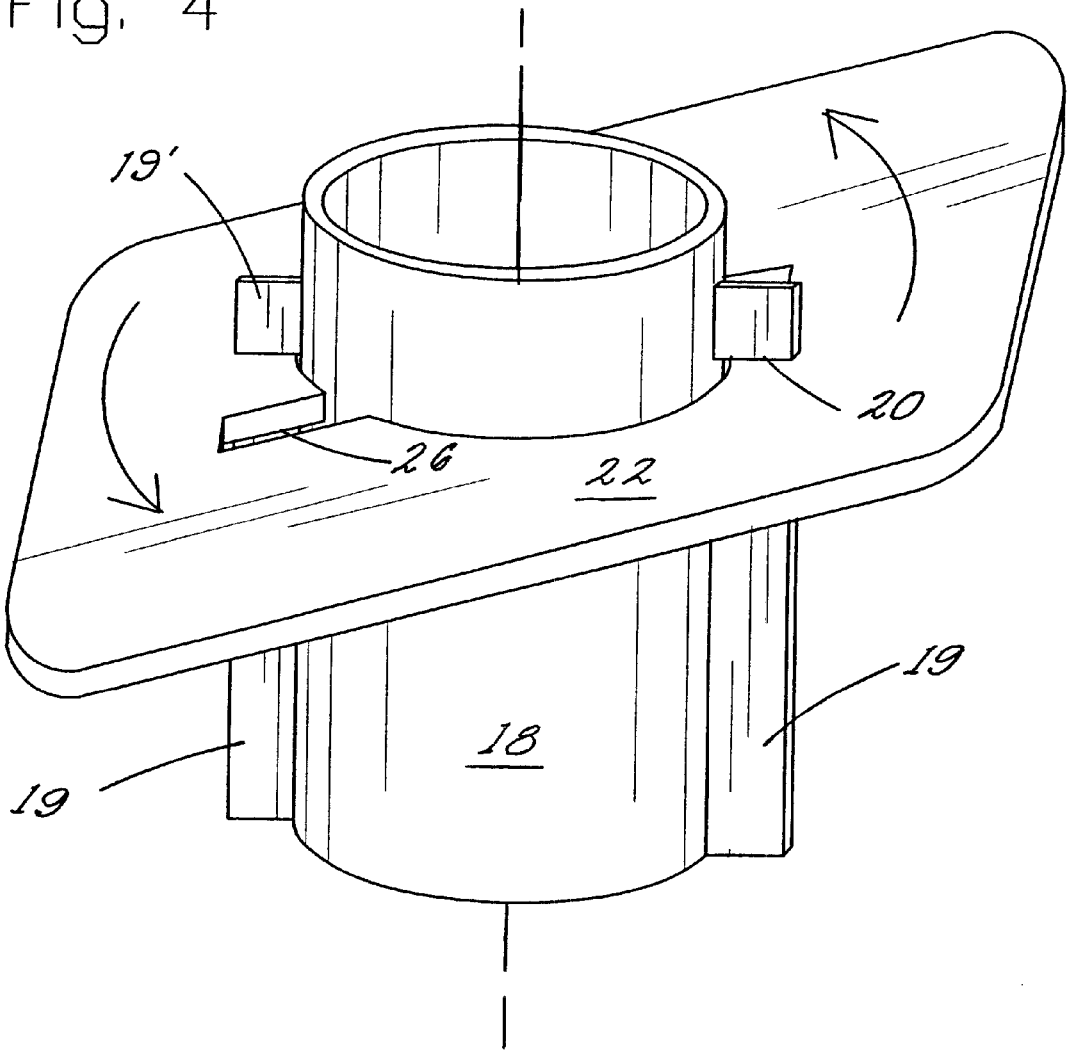
FIG. 4 is a detailed perspective view showing the golf cup retaining tube in locked condition with the retaining plate; and, FIG. 5 is a to view of a variation of the golf cup retaining tube.

In use plate 22 is positioned over the upper end of retaining tube 18 with slits 24 positioned over ears 18. The anchor plate is slipped down and over the retaining tube until plate 22 aligns with slots 20. At this point anchor plate 22 is rotated about retaining tube 16 a quarter turn or more locking plate 22 with tube 16 by way of slots 20, upper ears 19' and ears 19. See FIG. 4.

Returning to FIG. 2, pyracell mat 28 located above retaining plate 22. Mat 28 is formed with an opening 29 which is adapted to also receive the upper end of retaining tube 18.

Pyracell mat 28 is an extruded sheet of synthetic material formed to have a thickness of about 0.05". The plastic sheet is then molded to form a plurality of cells or cups 30 which extend upwardly from the base surface to a height of about 1". Cups 30 are evenly spaced over the upper surface of mat 28 and provide an elastic effect for the putting surface.

Located above pyracell mat 28 is the artificial turf 14. The artificial turf must provide a putting surface which has a consistent roll speed and is receptive to golf shots. It has been found that certain polypropylene fibers and certain nylon fibers provide an exceptional surface for this use. Normally, pile formed of these fibers to a height of ½" is most desirable. It is noted other pile forming material and other pile heights are acceptable.

As can be seen in FIG. 3, artificial turf 14 has a plurality of slits 32 cut to a length substantially equal to the diameter of hole 16. The slits form a plurality of tabs 34.

Golf cup 11 is shown above artificial turf 14.

The components, thus far described, form the major elements of the golf cup retaining system of the invention.

Figure 5:
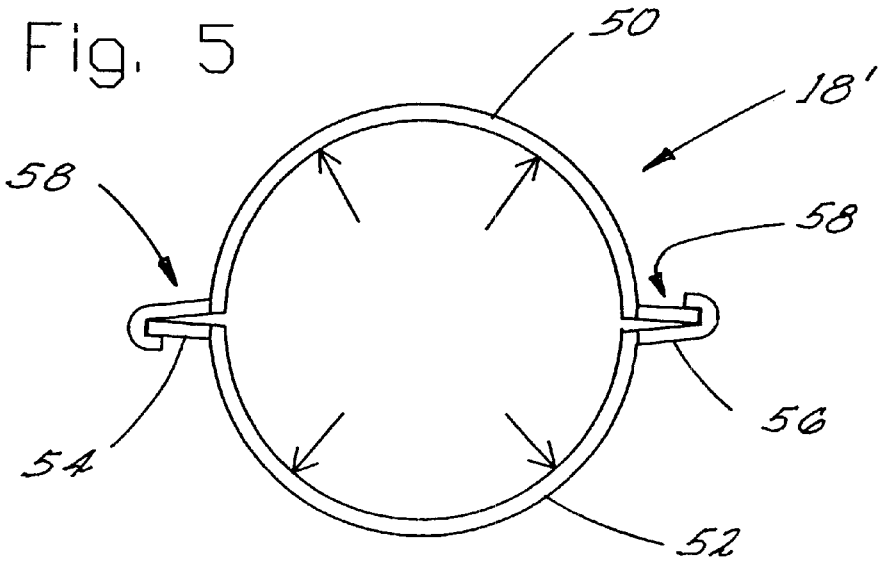

In a second arrangement shown in FIG. 5, retaining tube 18' may be formed of two elongated semicircular pieces 50, 52 each having opposed ears 54, 56 and each formed with slots 20. Ears 56 are formed with inwardly directed vertical grooves 58. Again, it is preferred that retaining tube 18' be made of synthetic material.

To construct retaining tube 18', the outer edges of ears 54 are positioned in grooves 58 with slots 20 aligned. Any suitable securing means, such as brads, nuts and bolts, or glue, may be used to form pieces 50, 52 into retaining tube 18'.

Returning now to FIG. 2, a prepared sub-base area 36 is shown containing the lower portion or about 7" of retaining tube 18. Tube 18 is buried to a depth in which the lower edge of slit 20 is substantially even with prepared surface 38. Retaining plate 22 is engaged in slit 20 and positioned to rest evenly upon prepared surface 38. This combination provides stability for the upper portion of retaining tube 18, holding it in a fixed vertical position.

The prepared surface is covered with a relatively course grade or a mortar grade of sand, which is dragged or raked to provide a smooth surface with no sharp contours. Sand 40 is between 1" to ⅛" deep, however adjacent to retaining tube 18 it must present an upper surface which is at least even with the upper edge of upper ear 19'.

Pyracell mats 28 are positioned over the surface of sand 40 with cups 38 having their open lower ends adjacent the sand and with the closed upper ends directed upwardly. The area between and around cups 38 is filled with a very fine grade of sand 42, such as silica sand. Silica sand 42 is brought even with or slightly above the level of the closed upper ends of cups 38 and again, the surface is drugged or raked to form a smooth, even surface.

Artificial turf 14, which consists of a backing 44 to which pile tufts 46 are secured, is placed over the sand covered pyracell mat 28 and sand 42. The outer edges of the artificial turf are anchored in position by any known means providing a smooth taut upper surface.

Finally, the area in between and around pile tufts 46 is filled with silica sand 42 to a level substantially even with the upper level or tips of the pile tufts.

The surface formed provides a consistent roll speed and a surface capable of receiving golf shots. That is it has appropriate give and recovery.

Slits 32 are now cut over the opening of cup retaining tube 18 allowing tabs 34 to drape over the upper edge and into the cylinder of the tube 18.

Pea gravel, or some other small stone pieces, are placed into retaining tube 18 to a level of about 3" or at the desired location to support the lower end of golf cup 11.

Golf cup 11 is placed into hole 16 engaging the pile surfaces of tabs 34. As the cup is pushed downward to a position of about ½" to 1" below the upper surface of artificial turf 14, the pile is compressed and in some instances the upper tube area may be slightly expanded, both applying pressure locking golf cup 11 in position.

The flag 7 may now be positioned in the golf cup.

While a preferred embodiment of the invention has been described using specific terms, such description is for illustrative purposes only, and it is to be understood that changes and variations may be made without departing from the spirit or scope of the following claims.

What is claimed is:

1. A golf cup retaining system for artificial greens, said retaining system comprising:

a prepared surface, a base and a sheet of artificial turf;

a retaining tube with one end embedded in said prepared surface below said base and an upper open end substantially aligned with an upper surface of said base;

said artificial turf extending over said upper end through said open end and into said retaining tube in segments which extend about said open upper end;

a golf cup positioned in said retaining tube below said upper end; wherein, said segments of artificial turf resiliently engage about an outer surface of said cup resiliently securing said cup in said retaining tube.

2. The system of claim 1 wherein said retaining tube is formed of plastic.

3. The system of claim 1 wherein said retaining tube includes a pair of opposed ears arranged along its periphery and extending in parallel with the longitudinal axis of said retaining tube.

4. The system of claim 3 wherein said ears terminate short of said upper end.

5. The system of claim 3 including a slot in each of said ears perpendicular to said longitudinal axis, said slots being formed a selected distance beneath said upper end.

6. The system of claim 5 including an anchor plate having a central opening with a pair of opposed outwardly directed slits, said central opening being adapted to receive said retaining tube and said slits being adapted to receive said ears.

7. The system of claim 6 including a locking system between said anchor plate and said retaining tube, said locking system comprising rotating said anchor plate so that upper and lower surfaces of said anchor plate are received within said slots.

8. The system of claim 7 wherein said slots are in opposed positions.

9. The system of claim 1 including an anchor plate, said anchor plate including a central opening sized to fittingly receive said retaining tube, said anchor plate being adapted to rest upon said prepared surface stabilizing said retaining tube in a vertical position.

10. The system of claim 6 including a locking system adapted to lock said plate in position about said retaining tube.

11. The system of claim 6 wherein said anchor plate is formed of metal plate.

12. The system of claim 1 wherein said artificial turf extending over and into said retaining tube comprises four equal sized extensions.

13. The system of claim 1 wherein said base includes synthetic sheets formed with raised cups positioned with their open ends over said prepared surface, said sheets act to smooth out deviations in said prepared surface and to provide a resilient sub-surface for compressing with the impact of arriving golf balls.

14. The system of claim 13 including sand filling intersies about and between said cups forming a smooth upper surface for said base.

15. The system of claim 1 wherein said retaining tube is formed of a pair of semicircular plastic sheets releasably secured along opposed longitudinal seams.

16. The method of providing a golf cup retaining system with an artificial putting green comprising:

providing a prepared surface over a selected area;

providing a retaining tube and burying a lower portion of said retaining tube beneath said prepared surface;

forming a base layer over said prepared surface of a depth which brings its upper surface substantially even with an upper end of said retaining tube;

laying artificial turf over said base layer and over said upper end of said retaining tube;

cutting said artificial turf extending over said upper end forming a plurality of strips which extend downwardly into said retaining tube;

positioning said golf cup within said retaining tube and in engagement with said strips; wherein, said strips act to resiliently secure said cup in position.

17. The method of claim 16 including providing a stabilizing plate and positioning said stabilizing plate on said prepared surface and about said retaining tube adjacent its upper end securing said retaining tube against lateral movement.

18. The method of claim 17 including providing a locking system locking said retaining plate and retaining tube in relative positions.

19. The method of claim 16 including forming said base layer of synthetic sheets formed with cups and sand laid over said prepared surface.

20. A golf cup retaining system for use with artificial greens comprising:

a retaining tube, having an upper and lower end adapted to receive a golf cup;

said retaining tube including at least a pair of elongated ears arranged along the periphery and parallel with the longitudinal axis of said retaining tube, said ears engaging along their longitudinal length and terminating below said upper end;

a retaining plate arranged about said retaining tube and locked in position with said retaining tube; whereby, said retaining tube may be partially buried with its upper end stabilized by said retaining plate.

21. The golf cup retaining system of claim 20 wherein said retaining tube is formed of a pair of semicircular elongated members each having opposed pairs of said elongated ears, securing means securing said elongated members together along opposed of said elongated ears.

* * * * *